US010519665B2

(12) United States Patent
Bunker, II

(10) Patent No.: US 10,519,665 B2
(45) Date of Patent: Dec. 31, 2019

(54) SKYLIGHT

(71) Applicant: INNOVATIONS MANUFACTURING, INC., Denver, CO (US)

(72) Inventor: Owen Woodruff Bunker, II, Denver, CO (US)

(73) Assignee: Innovations Manufacturing, Inc., Denver, CO (US)

( * ) Notice: Subject to any disclaimer, the term of this patent is extended or adjusted under 35 U.S.C. 154(b) by 0 days.

(21) Appl. No.: 15/902,556

(22) Filed: Feb. 22, 2018

(65) Prior Publication Data

US 2019/0257090 A1 Aug. 22, 2019

(51) Int. Cl.
*E04D 13/03* (2006.01)

(52) U.S. Cl.
CPC ..... *E04D 13/0315* (2013.01); *E04D 13/031* (2013.01)

(58) Field of Classification Search
CPC ..... E04D 13/0315; E04D 13/031
USPC ..... 52/200, 204.1, 309.7, 22, 64; 264/148, 264/255; 277/648, 630, 921, 631, 649; 29/897.3, 897.312
See application file for complete search history.

(56) References Cited

U.S. PATENT DOCUMENTS 3,461,625 A * 8/1969 Sandow ..... E04D 13/0305 52/200
4,703,592 A * 11/1987 Sampson ..... E04D 13/0305 52/20
4,995,208 A * 2/1991 Sampson ..... E04D 13/03 52/200
5,044,133 A * 9/1991 Sampson ..... E04D 13/0305 49/495.1
5,046,292 A * 9/1991 Sampson ..... E04D 13/0305 52/200
5,544,455 A * 8/1996 DeBlock ..... E04B 9/32 52/200
6,195,948 B1 * 3/2001 Lamanna ..... E04D 13/0305 52/200
6,263,624 B1 * 7/2001 Hoy ..... E04D 13/03 52/200
6,418,679 B2 * 7/2002 Widmer ..... E04D 13/02 277/630
2010/0269426 A1 * 10/2010 Richter ..... E04D 13/0315 52/171.3

(Continued)

*Primary Examiner* — Joshua K Ihezie
(74) *Attorney, Agent, or Firm* — Kilpatrick Townsend & Stockton LLP

(57) ABSTRACT

According to the invention, a skylight including a frame is disclosed. The skylight may include a frame. The frame may include a vertical curb and horizontal flashing integral with, and extending away from, a bottom of each exterior side of the vertical curb. The frame may also include a first vertical member extending upward from the horizontal flashing which extends from a first exterior side of the vertical curb, and a second vertical member extending upward from the horizontal flashing which extends from a second exterior side of the vertical curb, where the second exterior side is opposite the first exterior side. The frame may further include a first horizontal member extending from the first vertical member, and away from the vertical curb, as well as a second horizontal member extending from the second vertical member, and away from the vertical curb.

17 Claims, 5 Drawing Sheets

(56) References Cited

U.S. PATENT DOCUMENTS

2013/0340362 A1* 12/2013 Blomberg ..... E04D 13/032
52/200

* cited by examiner

SKYLIGHT

BRIEF SUMMARY OF THE INVENTION

In one embodiment, skylight including a frame is provided. The frame may include a vertical curb, horizontal flashing, a first vertical member, a second vertical member, a first horizontal member, and a second horizontal member. The horizontal flashing may be integral with, and extending away from, a bottom of each exterior side of the vertical curb. The first vertical member may extend upward from the horizontal flashing which extends from a first exterior side of the vertical curb. The second vertical member may extend upward from the horizontal flashing which extends from a second exterior side of the vertical curb, where the second exterior side is opposite the first exterior side. The first horizontal member may extend from the first vertical member, and away from the vertical curb. The second horizontal member may extend from the second vertical member, and away from the vertical curb.

In another embodiment, a method of installing a skylight is provided. The method may include disposing a frame of a skylight in a particular orientation on a roof. The frame may include a vertical curb having a first exterior side opposite a second exterior side, and a third exterior side opposite a fourth exterior side. The frame may also include horizontal flashing integral with, and extending away from, a bottom of each exterior side of the vertical curb. The frame may further include a first vertical member extending upward from the horizontal flashing which extends from a first exterior side of the vertical curb, and a second vertical member extending upward from the horizontal flashing which extends from a second exterior side of the vertical curb, where the second exterior side is opposite the first exterior side. The frame may additionally include a first horizontal member extending from the first vertical member, and away from the vertical curb, and also a second horizontal member extending from the second vertical member, and away from the vertical curb. The particular orientation in which the frame is disposed on the roof may be such that the third exterior side is located at a higher point on the roof than the fourth exterior side.

BRIEF DESCRIPTION OF THE DRAWINGS

Embodiments of the present invention are described in conjunction with the appended figures.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

For example, any detail discussed with regard to one embodiment may or may not be present in all contemplated versions of that embodiment. Likewise, any detail discussed with regard to one embodiment may or may not be present in all contemplated versions of other embodiments discussed herein. Finally, the absence of discussion of any detail with regard to embodiment herein shall be an implicit recognition that such detail may or may not be present in any version of any embodiment discussed herein.

Specific details are given in the following description to provide a thorough understanding of the embodiments. However, it will be understood by one of ordinary skill in the art that the embodiments may be practiced without these specific details. For example, well-known processes, structures, techniques, and other elements may not be discussed in great detail in order to avoid obscuring the embodiments.

Figure 1:
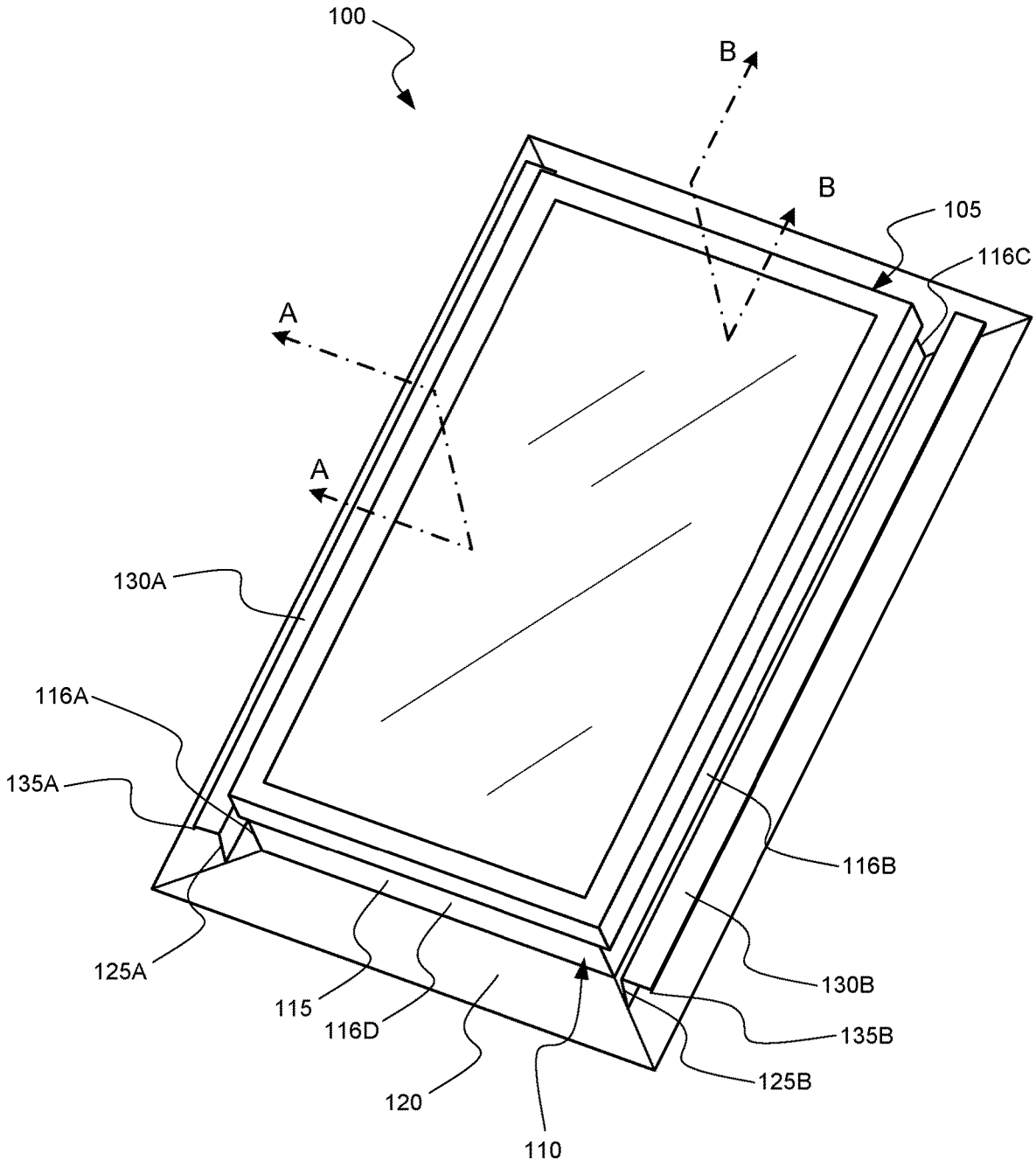
FIG. 1 is a perspective view of one skylight embodiment of the invention.
Figure 2:
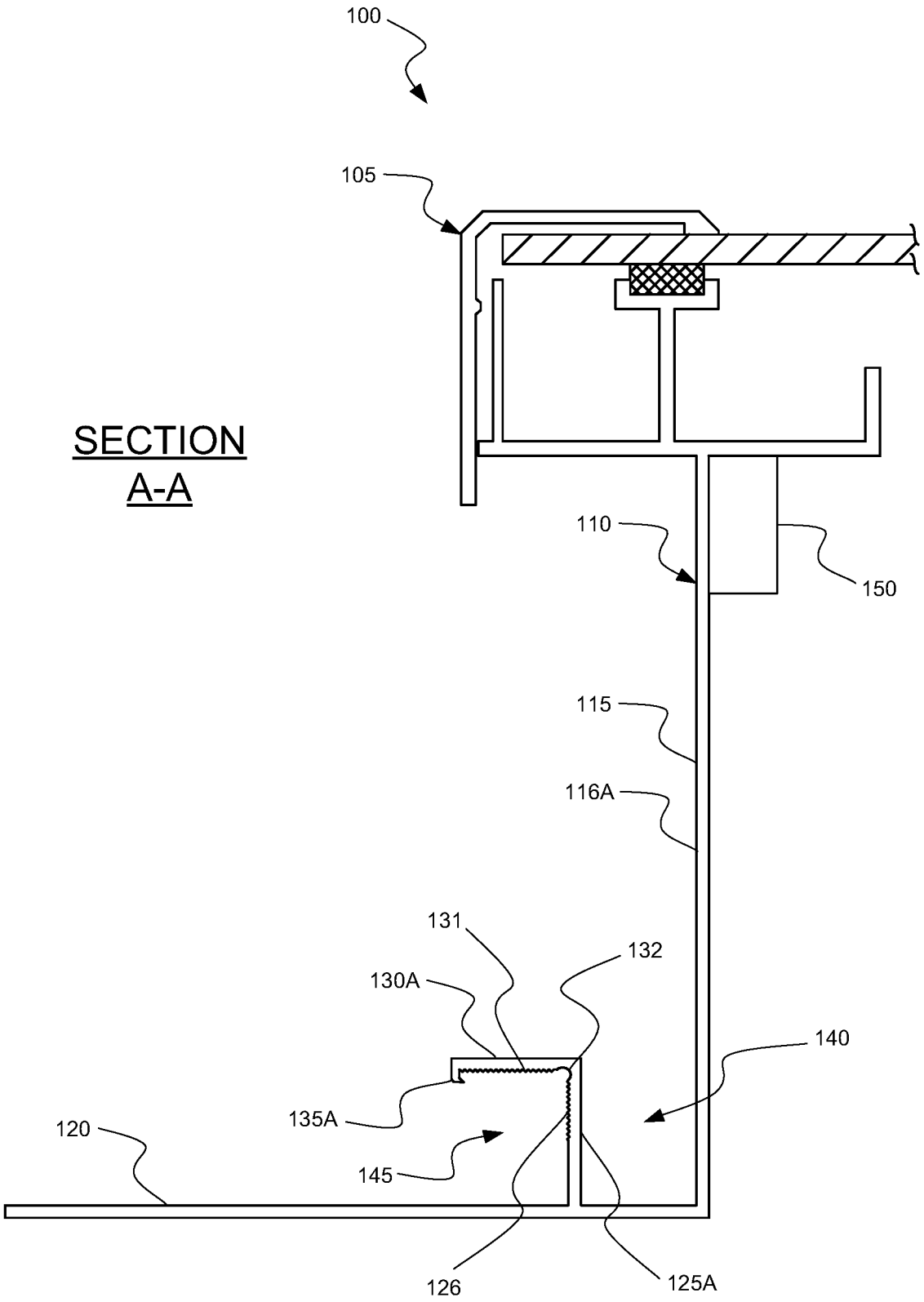
FIG. 2 is a first cross section of the skylight from FIG. 1.
Figure 3:
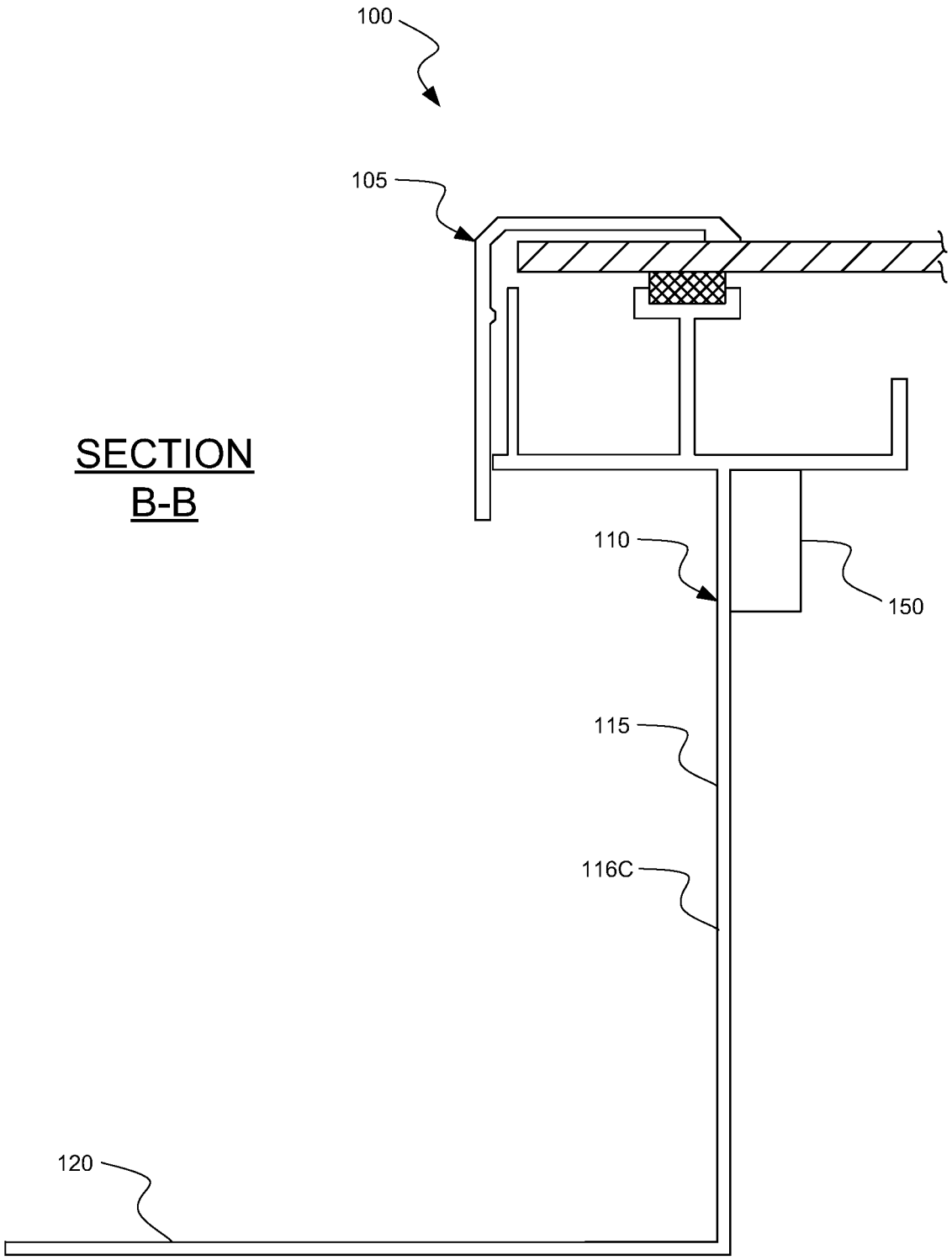
FIG. 3 is a second cross section of the skylight from FIG. 1.

In one embodiment, as shown in FIG. 1, a skylight 100 is provided. Skylight 100 may include a window assembly 105 and a frame 110 having a number of components. The components of frame 110 may include a vertical curb 115, horizontal flashing 120, a first vertical member 125A, a second vertical member 125B, a first horizontal member 130A, and a second horizontal member 130B. Some embodiments may also include a first vertical nub 135A and a second vertical nub 135B. FIG. 2 and FIG. 3 show cross sections A-A and B-B, respectively, of skylight 100. The components of frame 110 may be constructed of metal, polymer, or other suitable material.

Horizontal flashing 120 may be integral with, and extend away from, a bottom of each exterior side of vertical curb 115. By "integral with," a person of skill in the art should understand that the two components are of homogenous continuous construction, and form a single physical element. As shown in cross sections A-A and B-B, this also means that there is no interface between such components (horizontal flashing 120 and vertical curb 115). Having no interface between the two components (horizontal flashing 120 and vertical curb 115) at this location provides the advantage of removing an additional location that water may penetrate, that is perhaps present in prior art skylight frames. In some embodiments, horizontal flashing 120 may extend substantially orthogonally away from the bottom of each exterior side 116 of vertical curb 115. By "substantially orthogonal," a person of skill in the art should understand that an angle of 90 degrees, plus or minus two degrees, is intended.

First vertical member 125A may extend upward from horizontal flashing 120 which extends from a first exterior side 116A of vertical curb 115. In some embodiments, first vertical member 125A may be integral with horizontal flashing 120. First horizontal member 130A may extend from first vertical member 125A, and away from vertical curb 115. Likewise, on a second exterior side 116B, opposite first exterior side 116A, second vertical member 125B may extend upward from horizontal flashing 120 which extends from second exterior side 116B of vertical curb 115. In some embodiments, second vertical member 125B may be integral with horizontal flashing 120. Also similarly, second horizontal member 130B may extend from second vertical member 125B, and away from vertical curb 115. In some embodiments, first horizontal member 130A may be integral with first vertical member 125A, and second horizontal member 130B may be integral with second vertical member 125B.

In some embodiments, a bottom side of each horizontal member 130 may include a roughened, textured, or the like surface 131. Likewise, a portion of an outer side of each vertical member 125 may also include a roughened, textured, or the like surface 126. In some embodiments, as shown in FIG. 2, only a top portion of the outer side of each vertical member 125 may include the roughened, textures, or the like surface 126.

In some embodiments, first vertical nub 135A may extend downward from first horizontal member 130A at an opposite end of first horizontal member 130A from first vertical member 125A. Likewise, second vertical nub 135B may extend downward from second horizontal member 130B at an opposite end of second horizontal member 130B from second vertical member 125B. In some embodiments, first vertical nub 135A may be integral with first horizontal member 130A, and second vertical nub 135B may be integral with second horizontal member 130B. As shown in FIG. 2, vertical nubs 135 may be hook shaped.

Thus, as demonstrated in FIG. 2, a vertically-open channel 140 having an open top and a homogenous uninterrupted inner surface may be defined by each vertical member 125, horizontal flashing 120, and vertical curb 115. As also demonstrated in FIG. 2, a horizontally-open channel 145 having an open side and a homogenous uninterrupted inner surface may be defined by each horizontal member 130, each corresponding vertical member 125, and horizontal flashing 120.

In some embodiments, vertical members 125 may be substantially parallel with proximate/nearby exterior sides 116 of vertical curb 115. By "substantially parallel," a person of skill in the art should understand that parallel, plus or minus two degrees thereof, is intended. In some embodiments, horizontal flashing 120 may be substantially parallel with horizontal members 130. In some embodiments, vertical members 125 and exterior sides 116 of vertical curb 115 may be substantially orthogonal to horizontal flashing 120 and horizontal members 130.

In some embodiments, horizontal flashing 120 which extends from a third exterior side 116C of vertical curb 115 has no substantial features thereon. Third exterior side 116C of vertical curb 115 couples first exterior side 116A with second exterior side 116B. Likewise, in some embodiments, horizontal flashing 120 which extends from a fourth exterior side 116D of vertical curb 115 has no substantial features thereon. Fourth exterior side 116D of vertical curb 115 also couples first exterior side 116A with second exterior side 116B, but at the other end thereof.

In some embodiments, powered lights 150 may be present on the interior of vertical curb 115 or some other interior portion of skylight 100. The lights 150 may be powered by batteries, solar power, or hardwired external sources such as power from the associated structure.

Figure 4:
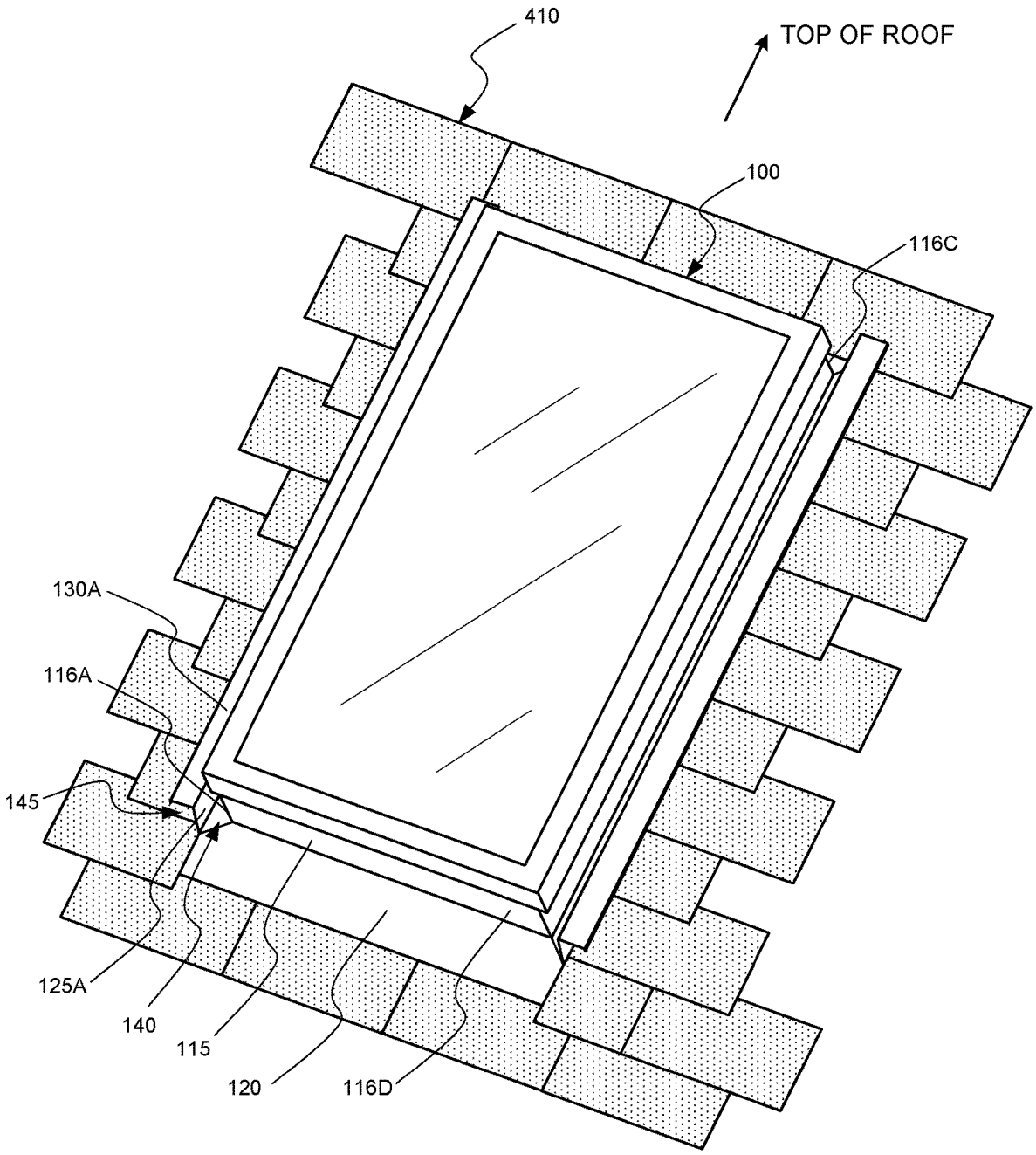
FIG. 4 is a perspective view of the skylight from FIG. 1, disposed on a roof with shingles.

FIG. 4 shows a perspective view of skylight 100 after installation on a roof. Skylight 100 has been disposed in a particular orientation on the roof so that third exterior side 116C is disposed at the top-most portion of the installation, while fourth exterior side 116D is located at the bottom-most portion of the installation. Shingles 410 have been disposed around skylight 100. Though only one layer of shingles 410 is shown, other construction materials, as well as additional layers of shingles 410 may also be present in some installations/embodiments.

Prior to disposing frame 110 of skylight 100 in this particular orientation on the roof, shingles 410 were disposed on the roof in the location that is underneath horizontal flashing 120 which extends from fourth exterior side 116D of vertical curb 115.

After disposing frame 110 of skylight 100 in the particular orientation on the roof, shingles 410 were disposed on the roof such that shingles 410 at least partially cover horizontal flashing 120 which extends from first exterior side 116A of vertical curb 115, and also such that shingles 410 abut first vertical member 125A underneath first horizontal member 130A. A sealant, mastic for example, may be disposed within horizontally-open channel 145 between shingles 410 and first horizontal member 130A, and grip to the surfaces of horizontally-open channel 145, including roughened, textured, or the like surfaces 126, 131 within said channel. In some embodiments, horizontal member 130 may be forced downward such that first nub 135A grips into shingles 410. Construction about the other side of skylight may be substantially similar, as shown in FIG. 4. An exaggerated sunken fillet 132, set into the inner-corner interface between vertical member 125 and horizontal member 130 may be present in order to ease the ability of horizontal member 130 to be forced/rotated downward.

Finally, to complete installation, after disposing frame 110 of skylight 100 in the particular orientation on the roof, shingles 410 may be disposed on the roof such that shingles 410 at least partially cover horizontal flashing 120 which extends from the third exterior side 116C of vertical curb 115.

As can now be seen, water flowing around skylight 100 from precipitation, etc. will proceed to flow around skylight 100, and flow down vertically-open channels 140, between vertical curb 115 and vertical members 125, avoiding the interface of shingles 410 to frame 110 which is located on the other side of vertical members 125. This contrasts to many prior art skylights where shingles may abut the vertical curb thereof directly, providing an interface between the shingles and the vertical curb for water to pass through damaging the roof and structure underneath.

Figure 5:
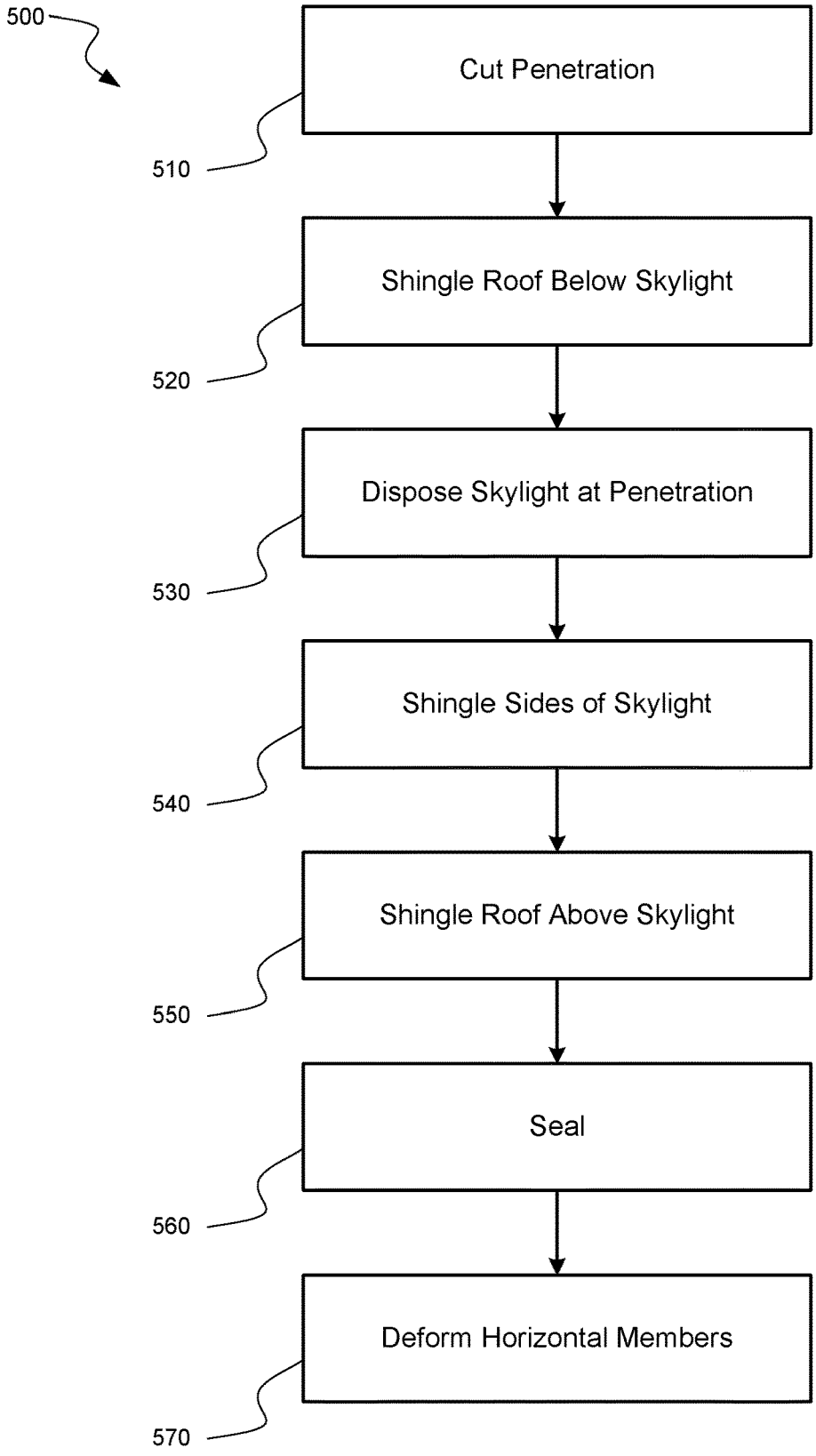
FIG. 5 is a flow diagram of one method embodiment of the invention for installing the skylight of FIG. 1.

FIG. 5 shows a block diagram of one method 500 of the invention for installing skylight 100. At block 510, a penetration (hole) is cut in the roof to the size appropriate for frame 110. At block 520, shingles 410 and other roofing materials are disposed on the roof below the penetration. At block 530, frame 110 is disposed over the penetration and shingles 410 already placed.

At block 540, shingles and other roofing materials are disposed on the sides of frame 110 such that they abut the outer face of vertical members 125. At block 550, shingles and other roofing materials are disposed over at least a portion of horizontal flashing 120 which extends from the top side of frame 110.

At block 560, a sealant is disposed in the space defined between shingles 410, vertical member 125, and horizontal members 130. Sealant may also be disposed at other locations where frame 110 interfaces with shingles 410. In some embodiments, at block 570, horizontal members 130 may be forced downward, potentially moving nubs 135 into shingles 410 and/or other roofing materials.

The invention has now been described in detail for the purposes of clarity and understanding. However, it will be appreciated that certain changes and modifications may be practiced within the scope of the appended claims.

What is claimed is:

1. A skylight including a frame, wherein the frame comprises:

a vertical curb;

horizontal flashing integral with, and extending away from, a bottom of each exterior side of the vertical curb;

a first vertical member extending upward from the horizontal flashing which extends from a first exterior side of the vertical curb, wherein:

the first vertical member is spaced apart from the vertical curb such that a first space between the first vertical member and the vertical curb forms a first vertically-open channel that separates the vertical curb from any roofing shingles; and the first vertically-open channel has first opposing open ends and a first homogenous, uninterrupted, and flat inner surface that provide a first water drainage path that prevents water from getting underneath the any roofing shingles and directs water downward and off of the frame;

a second vertical member extending upward from the horizontal flashing which extends from a second exterior side of the vertical curb, wherein the second exterior side is opposite the first exterior side, wherein:

the second vertical member is spaced apart from the vertical curb such that a second space between the second vertical member and the vertical curb forms a second vertically-open channel that separates the vertical curb from any roofing shingles; and the second vertically-open channel has second opposing open ends and a second homogenous, uninterrupted, and flat inner surface that provide a second water drainage path that prevents water from getting underneath the any roofing shingles and directs water downward and off of the frame;

a first horizontal member extending from the first vertical member, and away from the vertical curb;

a second horizontal member extending from the second vertical member, and away from the vertical curb;

a first vertical nub extending toward the horizontal flashing in a downward direction from the first horizontal member at an opposite end of the first horizontal member from the first vertical member; and a second vertical nub extending toward the horizontal flashing in a downward direction from the second horizontal member at an opposite end of the second horizontal member from the second vertical member.

2. The skylight of claim 1, wherein:

the first vertical nub is integral with the first horizontal member; and the second vertical nub is integral with the second horizontal member.

3. The skylight of claim 1, wherein:

the horizontal flashing extends substantially orthogonally away from the bottom of each exterior side of the vertical curb.

4. The skylight of claim 1, wherein:

the first vertical member is substantially parallel with the first exterior side of the vertical curb, and the first vertical member and the first exterior side of the vertical curb are substantially orthogonal to the horizontal flashing; and the second vertical member is substantially parallel with the second exterior side of the vertical curb, and the second vertical member and the second exterior side of the vertical curb are substantially orthogonal to the horizontal flashing.

5. The skylight of claim 1, wherein:

at least a portion of a bottom side of the first horizontal member comprises a roughened surface; and at least a portion of a bottom side of the second horizontal member comprises a roughened surface.

6. The skylight of claim 1, wherein:

at least a portion of a side of the first vertical member, not facing the vertical curb, comprises a roughened surface; and at least a portion of a side of the second vertical member, not facing the vertical curb, comprises a roughened surface.

7. The skylight of claim 1, wherein:

the first vertical member is integral with the horizontal flashing; and the second vertical member is integral with the horizontal flashing.

8. The skylight of claim 7, wherein:

the first horizontal member is integral with the first vertical member; and the second horizontal member is integral with the second vertical member.

9. The skylight of claim 1, wherein:

the horizontal flashing which extends from a third exterior side of the vertical curb has no substantial features thereon, wherein the third exterior side of the vertical curb couples the first exterior side with the second exterior side; and the horizontal flashing which extends from a fourth exterior side of the vertical curb has no substantial features thereon, wherein the fourth exterior side of the vertical curb couples the first exterior side with the second exterior side.

10. The skylight of claim 1, wherein:

the vertical curb and the horizontal flashing are of homogeneous construction with no interface formed between the vertical curb and the horizontal flashing.

11. The skylight of claim 1, wherein:

a first sunken fillet is set into a first inner corner interface formed between the first vertical member and the first horizontal member; and a second sunken fillet is set into a second inner corner interface formed between the second vertical member and the second horizontal member.

12. The skylight of claim 1, wherein:

a bottom surface of the horizontal flashing is substantially orthogonal with the vertical curb at a position most proximate the vertical curb.

13. The skylight of claim 1, wherein:

each of the first vertically-open channel and the second vertically-open channel is provided on lateral sides of the frame such that when installed on a roof, each of the first vertically-open channel and the second vertically-open channel is vertically-inclined from a first end of the frame to a second end of the frame.

14. The skylight of claim 1, wherein:

a most proximate end of the any shingles to the first vertically-open channel is secured underneath the first horizontal member such that the first vertically-open channel and the first horizontal member prevent water from getting underneath the most proximate end of the any shingles to the first vertically-open channel; and a most proximate end of the any shingles to the second vertically-open channel is secured underneath the second horizontal member such that the second vertically-open channel and the second horizontal member prevent water from getting underneath the most proximate end of the any shingles to the second vertically-open channel.

15. The skylight of claim 1, further comprising:

at least one lighting element positioned interiorly of the vertical curb.

16. The skylight of claim 15, wherein:

the at least one lighting element is solar powered.

17. The skylight of claim 1, wherein:

the frame is configured to be installed on a slope of a roof such that the first vertically-open channel and the second vertically-open channel are substantially parallel to the slope.

* * * * *